US006198457B1

(12) United States Patent
Walker et al.

(10) Patent No.: US 6,198,457 B1
(45) Date of Patent: Mar. 6, 2001

(54) LOW-WINDLOAD SATELLITE ANTENNA

(75) Inventors: Joel F. Walker, Malibu; Gerald E. Pollon, Glendale; Daniel G. Gonzalez, Topanga, all of CA (US)

(73) Assignee: Malibu Research Associates, Inc., Calabasas, CA (US)

( * ) Notice: Subject to any disclaimer, the term of this patent is extended or adjusted under 35 U.S.C. 154(b) by 0 days.

(21) Appl. No.: 09/169,454

(22) Filed: Oct. 9, 1998

Related U.S. Application Data

(60) Provisional application No. 60/061,635, filed on Oct. 9, 1997.

(51) Int. Cl.[7] ..... H01Q 15/16; H01Q 19/12

(52) U.S. Cl. ..... 343/840; 343/909; 343/912; 343/916

(58) Field of Search ..... 343/754, 709, 343/909, 840, 815, 753, 916, 912; H01Q 5/00, 19/12, 15/16

(56) References Cited

U.S. PATENT DOCUMENTS 3,893,123 * 7/1975 Bieser ..... 343/709
4,348,677 * 9/1982 Salmond ..... 343/840
4,647,943 * 3/1987 Metcalfe ..... 343/916
5,485,167 * 1/1996 Wong et al. ..... 343/815
5,543,809 * 8/1996 Profera ..... 343/909
5,554,999 * 9/1996 Gupta et al. ..... 343/909

OTHER PUBLICATIONS

*Flaps™ Reflector Antennas*, Malibu Research, publisehd at least as early as 1993.
Specification Sheet, "Low–Windload Flaps™ Antennas", published at least as early as 1993.
Specification Sheet, DMSP/HRPT Tracking Antenna System:, published at least as early as 1995.

* cited by examiner

*Primary Examiner*—Michael C. Wimer
(74) *Attorney, Agent, or Firm*—Hoffmann & Baron, LLP

(57) ABSTRACT

A satellite communications antenna includes a low-windload reflector so that the antenna may be used on high windload locations, such as on a ship. The reflector has a support structure which includes a grid-like structure having relatively large apertures therein to allow wind to pass therethrough. The reflector further includes reflective radiators, such as dipoles, mounted to the support structure for focusing at least one desired frequency of operation. The reflector is also formed in component parts for easy assembly/disassembly should it be necessary to deploy the system elsewhere.

23 Claims, 6 Drawing Sheets

LOW-WINDLOAD SATELLITE ANTENNA

RELATED APPLICATIONS

This application claims priority from United States Provisional Application No. 60/061,635 which was filed on Oct. 9, 1997.

BACKGROUND OF THE INVENTION

1. Field of the Invention

The present invention relates to a satellite data link and, more particularly to satellite antennas designed to be lightweight and have low-windload.

2. Description of the Prior Art

It is desirable in many applications involving the transmission and reception of microwave signals to provide a reflector/antenna to alter the travel of the signal to a focal point for reception. Such reflectors/antennas are commonly used on merchant and naval ships for establishing communications links. For example, commercial C-band satellites are currently in place which provide a high data rate connection, anywhere on the world's oceans, from ship to shore and back.

The C-band satellite systems (4 GHz downlink, 6 GHZ uplink) currently are the only satellite systems that provide full worldwide deep ocean coverage. High data rate C-band satellite communications systems typically require large antenna apertures for low cost, long term efficient operation. To date, high data rate communication systems have been limited to the largest ships due to the sail factor or windload presented by the large antenna and the corresponding dedicated space requirements for the antenna (large volume radome and associated platform).

Thus, it would be desirable to provide a low-windload satellite reflector for receiving and transmitting C-band communications signals which may be used on any size vessel. Furthermore, it would be advantageous to make the satellite reflector with a small footprint for mounting to a deck. Still another desirable feature would be to make the antenna deployable so that it may be taken down and easily deployed elsewhere on the vessel should the current mounting space be needed for other reasons.

OBJECTS AND SUMMARY OF THE INVENTION

It is an object of the present invention to provide a satellite reflector/antenna which has a low-windload so that it may be mounted anywhere upon any size vessel.

It is a further object of the present invention to provide a satellite reflector/antenna which is deployable, i.e., the reflector is easily dismantled and reassembled for deployment at another location if desired.

It is still a further object of the present invention to provide a low-windload satellite reflector/antenna and associated communications system capable of communicating with existing commercial C-band satellites.

It is yet another object of the present invention to provide a low-windload satellite reflector/antenna which has highly reflective properties only near the desired frequencies of operation and being substantially transparent outside the desired frequency bands.

In accordance with the present invention, a satellite reflector/antenna includes a reflector mounted to a pedestal wherein the pedestal has a base for mounting to a horizontal surface, such as a deck of a ship. The reflector is mounted to the opposite end of the pedestal by means of a steering platform capable of aiming the reflector at a desired satellite. The reflector may be either parabolic or substantially flat in shape. The reflector further includes an outer frame assembly. The frame assembly may include a plurality of radially extending spaced apart support arms extending to an outer periphery of the reflector as well as annular axial support members attached thereto. In a first embodiment, a grid-like support structure is mounted within the frame assembly. In a second embodiment, the support arms and axial support members define therebetween a subframe in which a grid-like support structure is provided. In either embodiment, the grid-like support structure has apertures therethrough such that grid intersections are spaced up to about $\lambda/2$ wavelength apart, where $\lambda$ is a desired wavelength of energy to be received by the antenna. Reflective radiators are arranged and mounted to the support assembly for reflecting a desired wavelength to a focal point of a reflector. A feed assembly is provided at the focal point of the assembly for receiving/transmitting energy at the desired frequency.

In accordance with the present invention, the support assembly is preferably made from a dielectric material and is parabolic in shape, although the reflector may take many different shapes. The support assembly is also formed in several parts, e.g., four quadrants, which can be mounted together to form the reflector making assembly/disassembly of the relatively large reflector easy so that it may be deployed in a different location should the need arise.

The reflective radiators are preferably in the form of dipoles which are particularly dimensioned to reflect energy of a selected frequency of operation. The dipoles are mounted to the support structure and, more specifically are in the shape of a cross such that the dipoles are mounted to intersections formed in the grid-like support structure. In order to effectively operate with existing C-band satellites, the antenna is frequency selective to the specific frequencies of operation for C-band communications. In a preferred embodiment, a first set of dipoles are mounted to a front surface of the support assembly for reflecting energy at a frequency F1 and a second set of dipoles are mounted to a back surface of the reflector support assembly for reflecting energy at a frequency F2, wherein the frequencies F1 and F2 are different. It is envisioned however, that the antenna may be set up to receive as few as one frequency or a number of frequencies, depending upon the requirements of the system. The system further includes electronics for processing received signals and generating signals for transmission by the antenna. The antenna is electrically connected to the electronics, preferably via fiberoptic cables or a waveguide and coaxial cables.

A preferred form of the satellite reflector/antenna and associated communications systems, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

The satellite communications system of the present invention is designed to utilize existing commercial C-band satellites for providing ship to shore communications. The antenna is further designed to be deployable such that should a need arise to move the cooperating equipment, the system may be easily dismantled and reassembled. The system, when deployed, is capable of providing a full T1 signal (1.544 MBps) to any ship or partitioning or sharing the bandwidth between ships. C-band satellite systems (4 GHz downlink, 6 GHz uplink) currently provide full worldwide deep ocean coverage. The communications system of the present invention overcomes the disadvantages of currently available systems by providing a deployable, low-windload antenna which can be used virtually on any ocean-going vessel.

Figure 1:
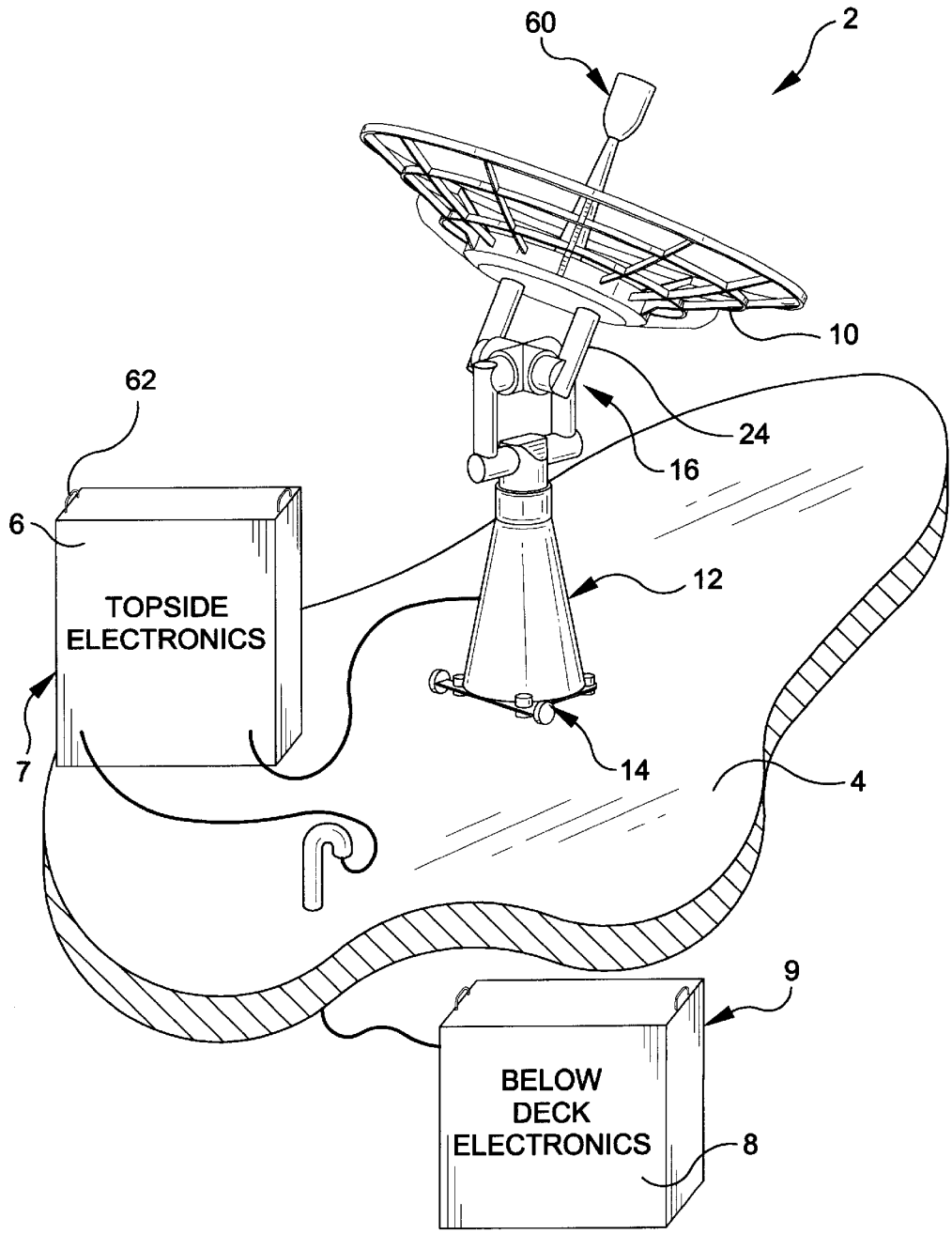
FIG. 1 is a partial block diagram of the communications system formed in accordance with the present invention.

Referring to FIG. 1, a satellite communications system utilizing the low-windload antenna of the present invention is illustrated in its deployed condition. The system generally includes a low-windload antenna 2 mounted to a horizontal surface such as the deck 4 of a ship. The antenna 2 is electrically coupled to electronic equipment 6 mounted within a topside electronic enclosure 7. It should be noted that the topside electronics may be mounted below deck. This electronic equipment is in turn electrically connected to additional electronic equipment 8 mounted within a below deck electronic enclosure 9. The communications system of the present invention is particularly designed for use on ships; however, the system may be used in any location in which windload is a factor or in which portability of the system is required.

The key component of the communications system is the low-windload antenna 2. The reflector portion of the antenna is preferably parabolic in shape, although it may take any other shape, such as flat, designed to reflect RF energy as if it were parabolic in shape. Such a reflector design is disclosed in commonly owned U.S. Pat. No. 4,905,014 entitled "Microwave Phasing Structures for Electromagnetically Emulating Reflective Surfaces and Focusing Elements of Selected Geometry", the disclosure of which is incorporated herein by reference.

Due to the high data rate of C-band satellite communications systems, the reflector 10 of the present invention is approximately 10 feet in diameter. In the preferred embodiment, a parabolic shaped reflector is utilized to provide a light-weight structure capable of withstanding high winds, shock and vibrations associated with operation on a vessel, particularly naval vessels. The reflector 10 is designed to include a grid-like structure having relatively large openings to create the low-windload antenna offering significantly reduced sail forces over conventional solid or mesh parabolic reflectors as will be discussed in greater detail below.

Figure 2:
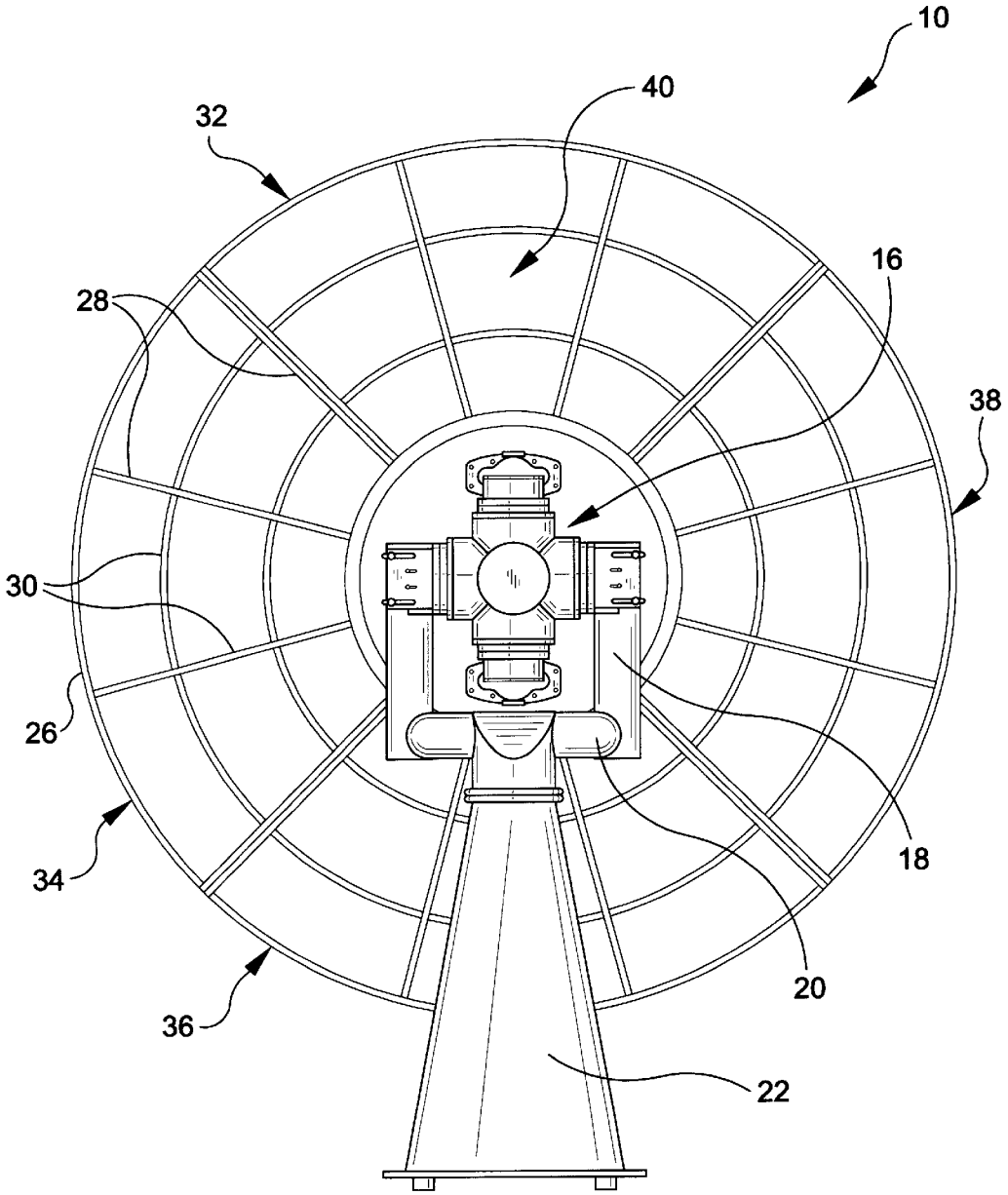
FIG. 2 is a rear elevation view of the pedestal and support assembly of a satellite antenna formed in accordance with the present invention.

As shown in FIGS. 1 and 2, the antenna 2 includes a pedestal 12 having a base 14 adapted to be secured to a horizontal surface such as the deck of a ship. When deployed, the pedestal base 14 is bolted to four davit sockets (not shown) provided on a ship's deck (similar to J davit sockets). If no davit sockets exist, they can be easily installed by welding a mounting plate to the deck at the desired location. The pedestal 12 supports and positions the ten foot diameter reflector 10 preferably using steering platform 16 in an x-y configuration. This type of steering platform configuration is particularly suited to track satellites which typically lie in high altitude orbits thus requiring frequent overhead (near zenith) reflector orientations. Furthermore, due to the ship's motion, constant reflector pointing corrections are necessary and the x-y approach is ideal in this situation since the axis velocities are minimized near zenith. However, it is envisioned that an elevation over azimuth positioner may also be used if desired.

The heart of the steering platform x-y positioner 16 is a powered cross with the x and y axes intersecting the center. It is so named a powered cross because the motors, gear reduction, data position transducers, rotary joints, and cable wraps are fully contained within the cross. This configuration results in a compact unit with rounded surfaces and no protruding devices or covers thereby minimizing reflected radar energy. In addition, no counterweights are used, thereby saving weight and enabling a more compact design. Each axis is preferably powered by a state-of-the-art brushless DC motor driving a special harmonic drive reducer with virtually zero backlash and low compliance, which assures high precision tracking accuracy and long operating life.

Referring to FIG. 2, the powered cross 16 is supported by two upright structural tubes 18, approximately six inches in diameter, which are supported by an approximately twelve inch diameter tube 20 secured to a conically-shaped riser base 22. The reflector 10 is attached to, and articulated by, two moving tubes 24 (FIG. 1), also approximately six inches in diameter, that are mounted to the reflector support assembly 26.

The reflector 10 is specifically designed to have low wind drag and is based upon the premise that any surface shape can be designed to behave electromagnetically as though it were a parabolic reflector. This effect is achieved by introducing appropriate phase delay at discrete locations along the reflector surface. A typical implementation of the concept consists of an array of shorted dipole scatterers positioned above a ground plane or above a reflecting shorted dipole. A more detailed description of this concept is provided in commonly owned U.S. Pat. No. 4,905,014, the disclosure of which was earlier incorporated by reference and which is commonly referred to in the industry as FLAPS™ (Flat Parabolic Surface) technology. Using this technology, it is possible to design the reflector of the present invention which has a very open structure with significantly less wind resistance than conventional reflectors.

Referring to FIG. 2, the preferred form of the reflector 10 includes a support assembly or frame 26 made from a dielectric material such as fiberglass composites or high strength plastics. The support assembly 26 includes a plurality of spaced apart radially extending support arms 28 as well as a plurality of spaced annular axial support members 30 connected to the radial support arms 28 at the intersections therebetween. In accordance with the preferred embodiment, the reflector 10 is able to be dismantled and reassembled with relative ease. To accomplish this goal, the reflector support assembly 26 comprises four sections 32, 34, 36, 38 capable of being removably mounted together to form the reflector support assembly.

Figure 3:
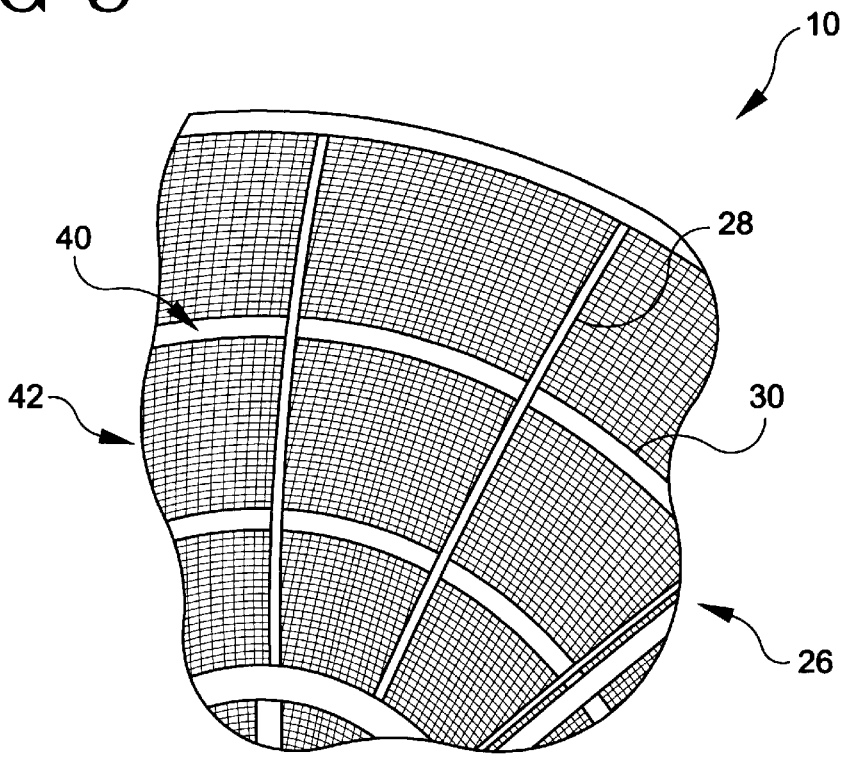
FIG. 3 is an exploded view of a portion of the support assembly of the reflector of the present invention.

The support assembly 26 is substantially open and the spaces between the radially extending support arms 28 and annular axial support members 30 form subframes 40. Referring to FIG. 3, within the subframes 40 is a grid-like support structure 42. The grid-like support structure is provided for the mounting of reflective radiators thereon to focus the received energy. In a most preferred embodiment, the grid-like support structure 42 is also formed from a dielectric material, and preferably a fiberglass composite. One method of making the support assembly 26 and grid-like support structure 42 includes forming a solid composite fiberglass-epoxy lay-up in the shape of the reflector. In the preferred embodiment, four quadrants are formed. After the composite cures, the grid structure is machined from the solid composite which results in a low-windload, nearly tennis racket appearance, although curved in the preferred embodiment. It will be appreciated by those skilled in the art that the reflector support assembly 26 may take many shapes and forms and be constructed using many different techniques. For example, the grid-like support structure may also be formed within the subframes by using high strength dielectric material strings, such as Kevlar®. The strings may be strung inside the subframes and interwoven in the style of a tennis racket to create the support structure. Yet a further technique to construct the grid support may be to use thin dielectric rods mounted within the subframes.

Figure 4:
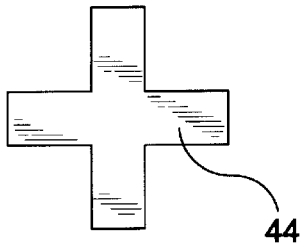
FIG. 4 is a top plan view of a dipole formed in accordance with the present invention.
Figure 6:
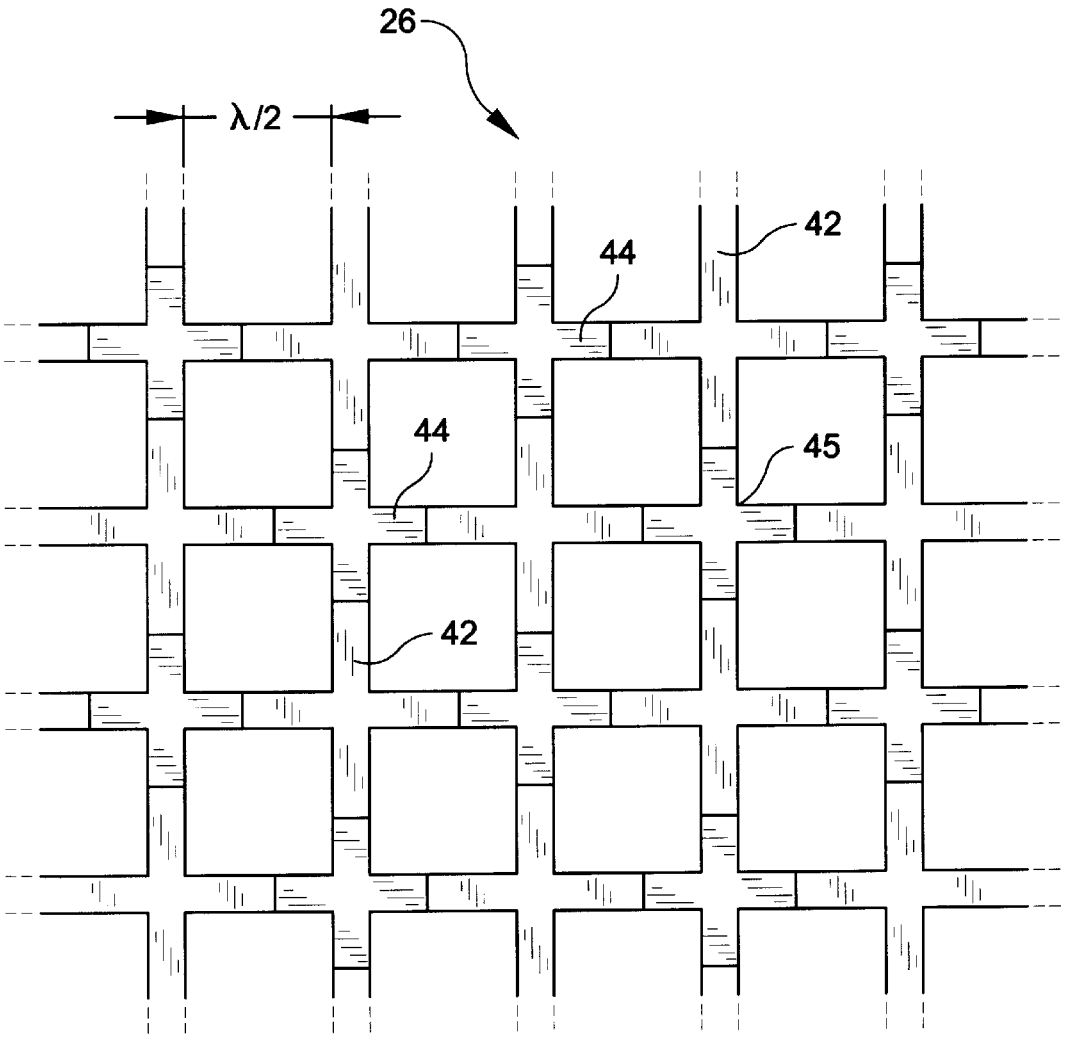
FIG. 6 is an enlarged top plan view of an arrangement of dipoles on the grid-like support structure formed in accordance with the present invention.

The reflector support assembly is required for mounting reflective elements thereon, such as dipole elements. Using the FLAPS™ technology, the dipole elements are preferably low-profile resonant cross dipoles which may be designed and mounted to operate at any desired frequency. FIG. 4 is an illustration of a cross dipole 44 which may be mounted to the reflector support assembly. The dipoles are generally formed of a dielectric substrate having a ground plane or reflective material mounted to the substrate. In the preferred embodiment, the dipoles are made from stamped copper sheets having a thickness of approximately 0.001–0.003 inches which are cut to size depending upon the frequency of energy to be reflected, the copper sheets having a pre-applied adhesive on a back surface thereof. The dipoles are arranged and affixed to the reflector support assembly to create a reflective surface at a desired frequency of operation. Referring to FIG. 6, the dipoles 44 are specifically arranged along the grid intersections 45 of the reflector support which are spaced a distance of up to approximately $\lambda/2$ wavelength apart, where $\lambda$ is the wavelength desired to be received and focused. In the preferred embodiment, the dipoles are placed at every other grid intersection 45. The grid spacing of the present invention is in sharp contrast to conventional mesh-type reflectors which require a wire grid having openings no larger than 1/16 to 1/20 of a wavelength for efficient operation. Due to the larger spacings available in the grid structure of the present invention, the windloading forces are typically 20% of those associated with a similarly sized solid or mesh reflector.

Figure 7:
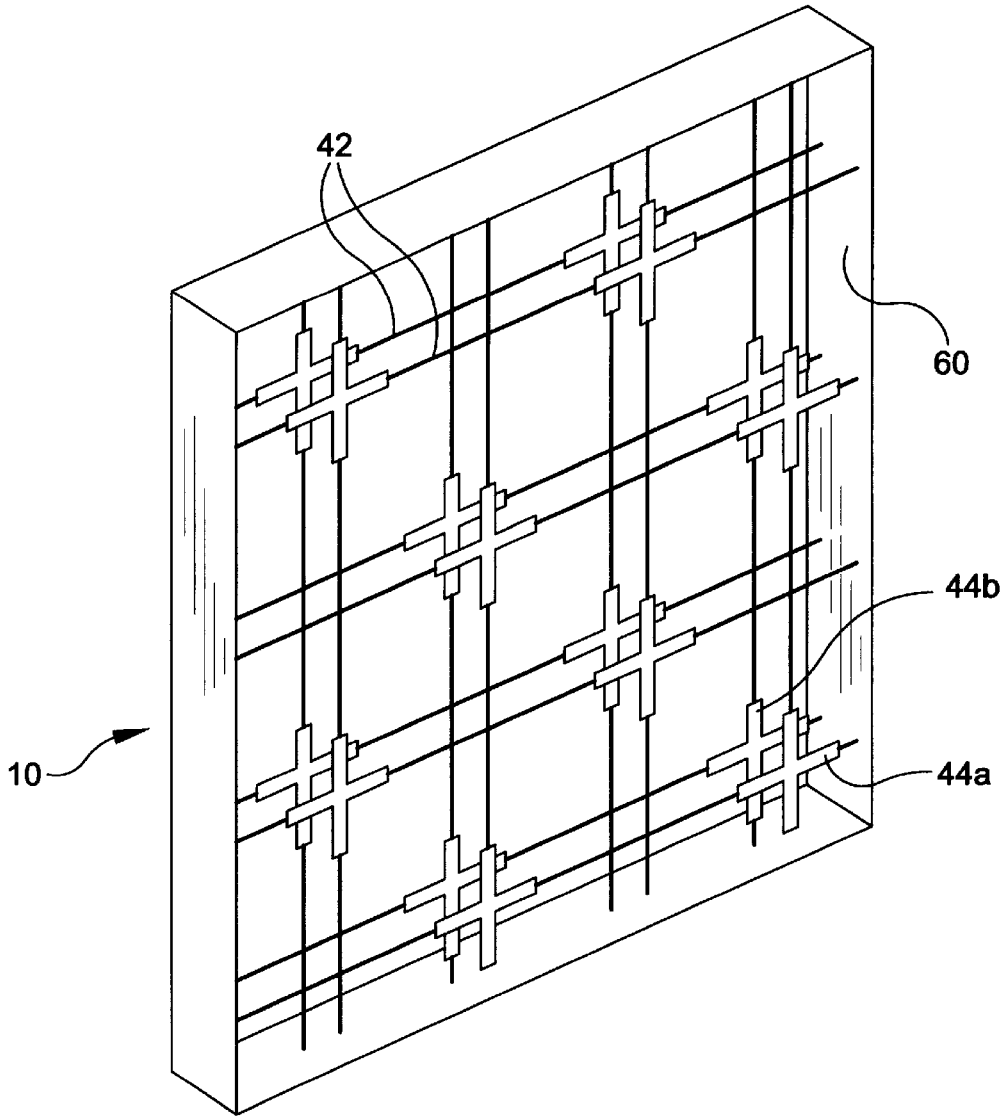
FIG. 7 is a perspective view of a flat reflector for use in the satellite antenna system of the present invention.

As earlier mentioned, the reflector 10 can be designed to receive either a single frequency or many frequencies depending upon the arrangement of dipoles and their respective size and shape. In the preferred embodiment, since C-band satellite systems operate generally at two given frequencies, 4 GHz downlink and 6 GHz uplink, the reflector is designed to be highly reflective only near those frequencies and outside those frequencies, the surface is essentially transparent. This is also important with respect to naval ships such that the reflector surface is also substantially transparent resulting in a very low radar cross-section, unlike conventional reflectors which are highly reflective at all frequencies. In order to be reflective at the C-band frequencies, the preferred embodiment of the present invention provides a dual band frequency selective surface. Resonant cross dipoles 44 as shown in FIGS. 4, 6 and 7 are arranged and affixed to a front surface of the reflector support assembly so as to operate and a first frequency F1. Slightly different sized dipoles, resonant at a second frequency F2 different from frequency F1, may be located on a back surface of the reflector. The dipoles on the front and back surfaces may be mounted at the same grid intersection locations, or at gird intersections not used by the front dipoles. Alternatively, all dipoles for operating at frequencies F1 and F2, or other frequencies may be mounted to a single surface.

Figure 5A:
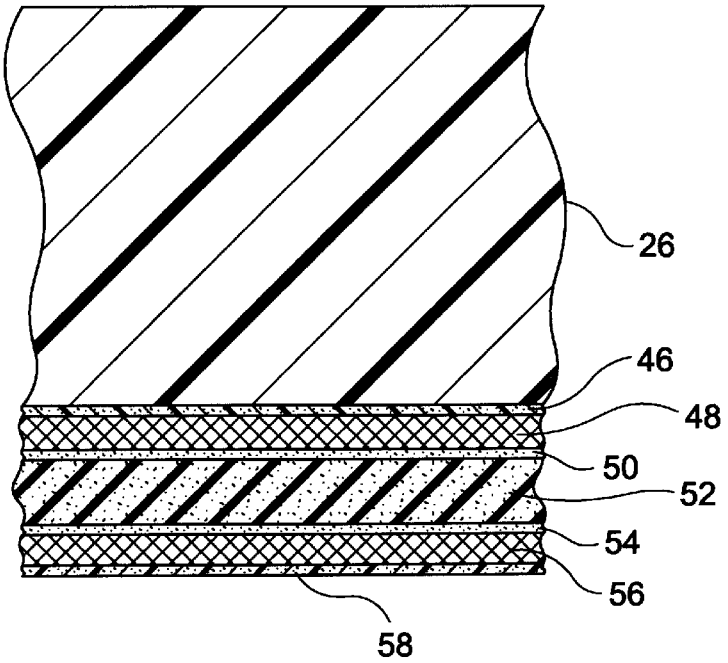
FIG. 5A is an enlarged cross-sectional view of a support assembly of the present invention having dipoles applied thereon during manufacture of the support assembly.

In an alternative embodiment, the dipoles 44 may be fabricated by embedding/applying the dipole material in the reflector composite lay-up prior to machining the grid structure. Referring to FIG. 5A, such a dipole arrangement is illustrated. The dielectric support structure 26 has applied thereto, in order from an inside surface to an outermost surface of the dipole, a laminating resin and inner layer of fiberglass 46, a first dipole mesh layer 48, a first epoxy bond coat 50, a synthetic foam layer 52, a second epoxy bond coat 54, a second dipole mesh layer 56 and an outer layer of fiberglass/polyester 58.

Figure 5B:
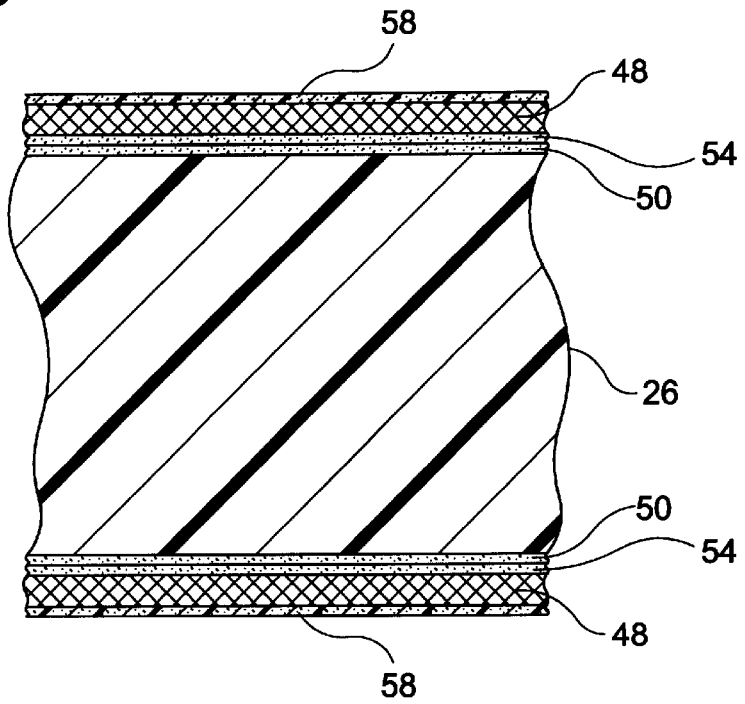
FIG. 5B is an enlarged cross-sectional view of an alternative support assembly structure having dipoles applied to the front and back surfaces during manufacture of the support assembly.

A still further embodiment having dipoles mounted to a front and back surface of the support assembly is illustrated in FIG. 5B. The dipoles are fabricated by embedding/applying the reflective dipole material 48 in the reflector composite lay-up prior to machining the grid structure. Alternatively, the dipoles may be mounted to the grid structure after it is formed. As shown in FIG. 5B the support assembly 26 is sandwiched between two dipoles. Each dipole may include an optional outer layer of fiberglass/polyester 58, a dipole mesh layer 48 and an epoxy bond coat or adhesive 50 to bond the mesh layer 48 to the support assembly 26.

As earlier discussed, using the technology described in commonly owned U.S. Pat. No. 4,905,014, i.e., FLAPS™ technology, it is possible to make the reflector portion of the antenna a substantially flat structure designed to reflect energy as if it were parabolic in shape. As illustrated in FIG. 7, the reflector 10 may be made flat having a frame 60, and a grid-like support structure 42. As shown in FIG. 7, the grid-like support structure includes a pair of aligned, spaced apart support grids for supporting two sets of dipoles 44*a*, 44*b* for receiving at least two specific frequencies of energy as earlier discussed. The support grid 42 may be formed using dielectric rods or strings mounted with the dielectric frame 60. Similar to the parabolic reflector, the grid openings are relatively large thereby providing a low-windload reflector. A feed assembly (not shown) would also be mounted at the focal point of the reflector for receiving/transmitting energy.

The low windload reflector designed in accordance with the present invention resembles a very coarse screen allowing the wind to easily pass through it with very little wind resistance. Since the reflector has very low windload characteristics, it is not impacted by aircraft flight operation turbulence. Furthermore, the reflector does not present a large sail factor and large overturning moments when the ship is in high wind conditions. Just as the reflector is not greatly affected by high winds, it also does not greatly disturb winds passing through it. Accordingly, the reflector presents for less of a threat to flight operations immediately downwind of the antenna as compared to a conventional parabolic reflector or radome housed antenna.

In order to maintain a link with the satellite of interest, the associated antenna electronics include an autotracking feed which monitors the beacon signal from the satellite. While monitoring the beacon signal strength, the autotracking feed continuously moves the focal point, via solid state circuitry, slightly up and down and left and right. This results in the antenna beam essentially "wiggling" a fraction of a beamwidth around the satellite. If the antenna is positioned to stare precisely at the satellite of interest, the measured beacon signal strength will not change throughout this wiggling. However, if the antenna is drifting away from the precise direction of the satellite, the measured beacon signal strength will weaken in one position. This signal difference will result in a stabilization control circuitry command to the stabilizer assembly (powered cross) to point the antenna in the proper direction. This continuous monitoring of the beacon signal strength assures the antenna will stay pointed towards the satellite of interest regardless of the ships movement. The autotracking feed also enables communication with older commercial satellites that have drifted into inclined orbits and are no longer geostationary. The leased time on these satellites is generally far less expensive than time changes from a geostationary satellite. Due to the autotracking feed capabilities, the system of the present invention performs equally well with either type of satellite.

As illustrated in FIG. 1, the antenna further includes a feed assembly 60 mounted to a center of the reflector and extending outwardly therefrom to the focal point thereof. The feed assembly receives the focused signals and provides them to the topside shipboard electronics.

The shipboard electronics 6 are mounted in an environmentally protected water-tight enclosure 7. The shipboard electronics may be deployed above or below deck near the antenna. The enclosure 7 preferably includes shock mounting with a bolt mechanism similar to that for mounting the base of pedestal to the ship's davit mountings on the deck. The enclosure 7 also preferably includes eye hooks 62 for lifting the unit. The enclosure may also contain a cooler, desiccant and insulation to provide a better controlled environment for the electronics.

The electronic equipment 6 provided within the enclosure can be arranged so that all cabling from the antenna to the system and remote terminal may be via external connections only, not requiring opening of the enclosure. The following electronic equipment is provided within the enclosure: an antenna control unit, servo amplifiers, up converter, down converter, modem, solid state power amplifier, cabinet cooler and a fiber optic interface.

The topside electronics 6 receives signals and commands from a manual control unit and auto-input of the ships position and heading information. There may also be an input for a remote diagnostics terminal which is used for troubleshooting and routine maintenance operations. The manual control unit is used primarily to manually input the location and channel of the satellite of interest. It is preferably a standard lap top computer with software for determining the respective location of the satellite of interest.

The below deck electronics 8 are provided in a similar enclosure 9 to the topside electronics and provide a centralized communications hub that integrates and interconnects data, voice, and video communications facilities onboard a ship. The electronics contain the necessary equipment for ship connectivity and provides the following minimum capabilities: 1.544 MBps full-duplex ATM (frame relay) connectivity across satellite link; 1.544 MBps full-duplex (ATM) to another ship via a WSK-3 radio; multiple trunk lines to the voice telephone PBX; videoconferencing interfaces; full firewalling of all data (IP) communications; and MPEG 1/MPEG 2 video communications using external storage and decoding equipment.

The enclosure 9 contains a ATM switch, router and power conditioner. Through the use of ATM technology, it allows the use of common internal and external communications channels to support multiple data types, allowing efficient and flexible use of the available T1 bandwidth. Through the high throughput C-band satellite link, it supports the external communications requirements of a ship at sea. With its internal file and video server and its interfaces to the telephone PBX, video distribution, and LAN networks within the ship, it fully integrates these facilities into common information distribution network. By integrating these facilities into a single unit, it allows the swift and convenient installation of a common networking methodology on all ships. Through the use of standard internal interfaces, it allows the individual pieces of equipment to be sized to each ship's requirements and upgraded as those requirements expand and change.

Depending upon requirements for operation, the system can provide the following services onboard the ship:

E-mail, X.500 directory service, Internet access and other computer services;

IP connectivity to shore-based applications and data repositories, including personnel, medical and training records; super computer connectivity;

Video teleconferencing, including remote technical assistance; remote medicine; program management and as a Tactical Planning Aid;

Realtime video on demand and offline downloading of training and briefing films, including a local video server;

MPEG video distribution over the onboard LAN network;

Long distance telephone services;

Local file services to support network computers, PCs, workstations, wearable computers, and laptops with wireless LANs; and Multimedia (voice, data and video) connectivity to other ships.

The communications system of the present invention provides global two-way T1 data communication using commercial C-band satellites. The system's unique light weight, low-windload antenna can operate in rough seas and high winds without the necessity of a radome housing. Because the antenna and supporting electronics are easily deployable, the system can occupy non-dedicated space and be quickly dismantled and deployed elsewhere, if necessary. Due to its light weight, small footprint and low sail effect, the antenna can be installed in a number of locations, even high on an upper deck. The frequency selective property of the low-windload antenna reflector exhibits a natural low radar cross-section out of band as well as out of band signal rejection. Accordingly, the antenna provides minimal radio frequency (RF) impact on other systems and immunity from interference that may be caused by other shipboard RF systems. The pedestal 12 and stabilization system (powered cross) 16 are also designed using curved surfaces and no right angles to complement the low radar cross-section properties of the reflector 10.

Although the illustrative embodiments of the present invention have been described herein with reference to the accompanying drawings, it is to be understood that the invention is not limited to those precise embodiments, and that various other changes and modifications may be effected therein by one skilled in that art without departing from the scope or spirit of the invention.

What is claimed is:

1. A satellite communications antenna, comprising:

a parabolic reflector;

a support structure for supporting the antenna on a horizontal surface, an opposite end of said support structure having the reflector mounted thereto; wherein the parabolic reflector comprises a gridded support assembly, said gridded support assembly having relatively large apertures therethrough, such that wind flows freely therethrough substantially without interference; and an array of shorted dipoles, each dipole comprising a cross-shaped member arranged on and mounted to the support assembly at grid intersections thereof, the shape of the support assembly in combination with the array of dipoles focusing a desired wavelength of energy.

2. A satellite communications antenna as defined in claim 1, wherein the gridded support assembly is made from a dielectric material.

3. A satellite communications antenna as defined in claim 1, wherein the gridded support assembly further comprises at least one radially extending support arm, at least one annular axial support member and an outer periphery support member coupled to at least one support arm.

4. A satellite communications antenna as defined in claim 1, wherein the gridded support assembly is formed in component parts which are detachably mounted together.

5. A satellite communications antenna as defined in claim 1, wherein the gridded support assembly is integrally formed.

6. A satellite communications antenna as defined in claim 1, wherein the gridded support assembly is formed from one of interwoven strings and thin rods of a dielectric material.

7. A satellite communications antenna as defined in claim 1, wherein the shorted dipoles are mounted to both a front and back surface of the parabolic reflector.

8. A satellite communications antenna as defined in claim 7, wherein the dipoles mounted to the front surface are reflective at frequency F1 and the dipoles mounted to the back surface are reflective at frequency, F2, where F1 and F2 are different frequencies.

9. A satellite communications antenna as defined in claim 1, wherein the support structure includes a positioner for aiming the reflector.

10. A satellite communications antenna as defined in claim 1, wherein the antenna further includes a feed assembly mounted above the parabolic reflector positioned at a focal point thereof.

11. A low-windload reflector as defined in claim 10, wherein the support assembly is made in at least two component parts for easy assembly/disassembly.

12. A satellite communications antenna as defined in claim 1, wherein the intersections of the gridded support assembly are spaced about $\lambda/2$ wavelength apart, where $\lambda$ is a desired wavelength of energy to be received by the antenna.

13. A satellite communications antenna as defined in claim 1, wherein a first array of shorted dipoles is tuned to operate at a first frequency F1 and a second array of dipoles is tuned to operate at a second frequency F2, wherein frequency F1 is different from frequency F2.

14. A satellite communications antenna as defined in claim 13, wherein the first array and second array are both mounted to grid intersections on a top surface of the reflector.

15. A satellite communications antenna as defined in claim 13, wherein the first array is mounted to grid intersections on a top surface of the reflector and the second array is mounted to grid intersections on a bottom surface of the reflector.

16. A low-windload reflector for use in a satellite communications antenna, comprising:

a parabolic-shaped support assembly comprising a gridded support structure, the gridded support structure having relatively large apertures therein to allow wind to flow freely therethrough; and an array of cross-shaped reflective radiators mounted to the gridded support structure at grid intersections thereof, a combination of the shape of the support assembly and the size, shape and spacing of the reflective radiators providing a reflective surface at a desired frequency.

17. A low-windload reflector as defined in claim 16, wherein the gridded support structure apertures form grid intersections which are spaced about $\lambda/2$ wavelength apart, where $\lambda$ is the desired frequency of operation.

18. A low-windload reflector as defined in claim 16, wherein the array of reflective radiators are dipoles and further wherein the array of dipoles comprises at least a first set of dipoles mounted to the reflector support assembly for reflecting energy at a frequency F1 and at least a second set of dipoles are mounted to the reflector support assembly for reflecting energy at a frequency F2, such that frequency F1 and F2 are different.

19. A low-windload reflector as defined in claim 16, wherein the gridded support structure includes apertures such that grid intersections are spaced about $\lambda/2$ wavelength apart, where $\lambda$ is the desired frequency of operation.

20. A low-windload reflector as defined in claim 18, wherein the first set of dipoles is mounted to a front surface of the reflector support assembly and the second set of dipoles is mounted to a back surface of the reflector support assembly.

21. A low-windload reflector as defined in claim 18, wherein both the first and second set of dipoles are mounted to the same surface of the reflector support assembly.

22. A low-windload reflector as defined in claim 16, wherein the support assembly is formed as a solid structure from which material is removed to create the gridded support structure.

23. A satellite communications system for use on ship, comprising:

a satellite communications antenna which includes a parabolic reflector and a pedestal having a base for mounting to a deck of a ship and the reflector being mounted to an opposite end thereof, the parabolic reflector including a support assembly comprising a gridded support structure, the reflector further including a plurality of reflective radiators comprising shorted dipoles mounted to intersections of the gridded support structure, the combination of the parabolic shape of the reflector and the size, shape and spacing of the reflective radiators mounted thereto focusing energy to a desired wavelength, the antenna further including a feed assembly positioned at the focal point for receiving/transmitting energy at the desired wavelength.

* * * * *